US006676331B1

(12) United States Patent
Casale

(10) Patent No.: US 6,676,331 B1
(45) Date of Patent: Jan. 13, 2004

(54) ROADWAY DELINEATOR FOR NEW JERSEY-TYPE CONCRETE BARRIERS

(76) Inventor: Alfredo Casale, V. Le Firenze 99/A, 06034 Foligno - PG (IT)

( * ) Notice: Subject to any disclaimer, the term of this patent is extended or adjusted under 35 U.S.C. 154(b) by 0 days.

(21) Appl. No.: 09/964,877

(22) Filed: Sep. 28, 2001

(51) Int. Cl.[7] ..... E01F 15/00

(52) U.S. Cl. ..... 404/6; 404/9; 256/13.1; 116/63 R

(58) Field of Search ..... 404/6, 9; 256/1, 256/13.1; 116/63 T, 63 P

(56) References Cited

U.S. PATENT DOCUMENTS

| | | | | | |
|---|---|---|---|---|---|
| 3,593,681 | A | * | 7/1971 | Sernovitz | 116/63 P |
| 3,734,595 | A | * | 5/1973 | Bendzick | 359/553 |
| D236,095 | S | | 7/1975 | Golden | |
| 3,934,541 | A | * | 1/1976 | May et al. | 116/63 T |
| 3,934,542 | A | * | 1/1976 | May et al. | 116/63 P |
| 4,224,002 | A | | 9/1980 | Heenan et al. | |
| 4,249,832 | A | * | 2/1981 | Schmanski | 256/13.1 |
| 4,403,565 | A | * | 9/1983 | Bleiweiss et al. | 116/63 T |
| 4,440,104 | A | * | 4/1984 | Bleiweiss et al. | 116/63 T |
| 4,723,758 | A | * | 2/1988 | Gehrig | 256/1 |
| 4,954,009 | A | | 9/1990 | Kellison | |
| 5,049,001 | A | | 9/1991 | Dinitz | |
| 5,429,448 | A | * | 7/1995 | Ballesteros | 116/63 R |
| 5,950,992 | A | * | 9/1999 | Weid | 256/1 |
| 6,224,290 | B1 | * | 5/2001 | Lavis | 256/13.1 |
| 2002/0059893 | A1 | * | 5/2002 | Kim | 116/63 T |

* cited by examiner

*Primary Examiner*—Robert E. Pezzuto
*Assistant Examiner*—Alexander K. Pechhold
(74) *Attorney, Agent, or Firm*—Shlesinger, Arkwright & Garvey LLP

(57) ABSTRACT

A roadway delineator comprises first and second reflectors; a pivot joining respective one ends of the first and second reflectors; and the first and second reflectors have first and second tabs, respectively, for attachment to a side wall of a barrier.

20 Claims, 2 Drawing Sheets

FIG. 1
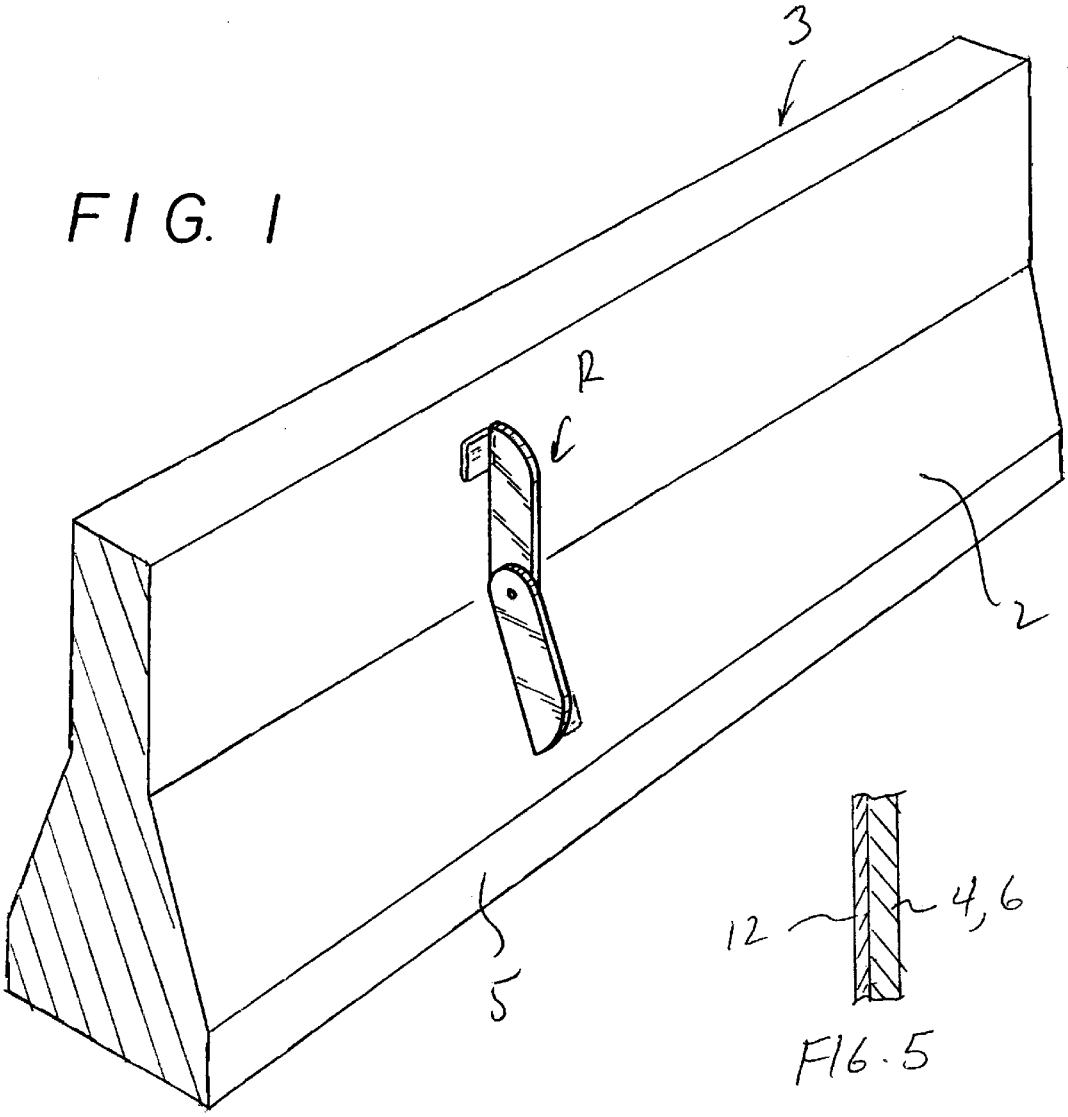
FIG. 5
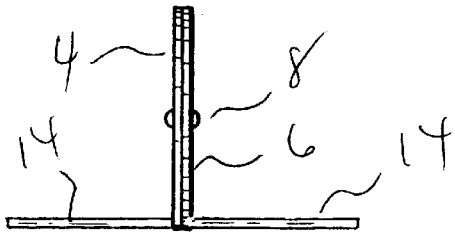
FIG. 4

ROADWAY DELINEATOR FOR NEW JERSEY-TYPE CONCRETE BARRIERS

FIELD OF THE INVENTION

The present invention relates generally to a roadway delineator and particularly to a roadway delineator that can be fitted to the side wall of a New Jersey-type concrete barrier of various shapes.

BACKGROUND OF THE INVENTION

New Jersey-type barriers are well known. They are longitudinally extending cast concrete structures typically used as median dividers to separate opposing traffic in roadways. In cross-section, the barriers have a broad, flat base and a vertical wall that tapers from wide to narrow starting at the base. These barriers are also used to protect construction crews working on the roadway.

During bad weather, road markings defining the edge of the roadway may not be visible to the motorist, especially when it is night and raining when the glare from the headlights could obscure the reflective road markings. Consequently, when a motorist loses sight of the edge of the road and veers off the pavement, he could conceivably hit the wide base of the barrier. Without the aid of markers, it would be hard to figure where the road ends and the barrier begins.

There is, therefore, a need to provide reflectors on the side walls of New Jersey-type barriers to delineate the extent of the lower portion of the barriers to alert the driver where the barrier begins even during bad weather when road markings defining the edge of the roadway may not be visible.

OBJECTS AND SUMMARY OF THE INVENTION

It is an object of the present invention to provide a roadway delineator for attachment to the side wall of a New Jersey-type concrete barrier to define the side wall and the base of the barrier under normal and inclement weather.

It is another object of the present invention to provide a roadway delineator that can be fitted to various shapes of the side walls of the New Jersey-type barriers.

In summary, the present invention provides a roadway delineator comprising first and second reflectors; a pivot joining respective one ends of the first and second reflectors; and the first and second reflectors have first and second tabs, respectively, for attachment to a side wall of a barrier.

The present invention also provides a roadway delineator, comprising first and second longitudinal reflectors joined together at respective one ends; tab secured to at least one of the first and second longitudinal reflectors for attachment to a side wall of a roadway barrier; and the first and second longitudinal reflectors are disposed at an angle relative to each.

These and other objects of the present invention will become apparent from the following detailed description.

BRIEF DESCRIPTIONS OF THE DRAWINGS

FIG. 1 is a perspective view of a roadway delineator made in accordance with the present invention.

FIG. 4 is a bottom edge view of FIG. 3.

FIG. 5 is an fragmentary enlarged cross-section view taken along lines 5—5 and 5'—5'in FIG. 3.

DETAILED DESCRIPTION OF THE INVENTION

Figure 2:
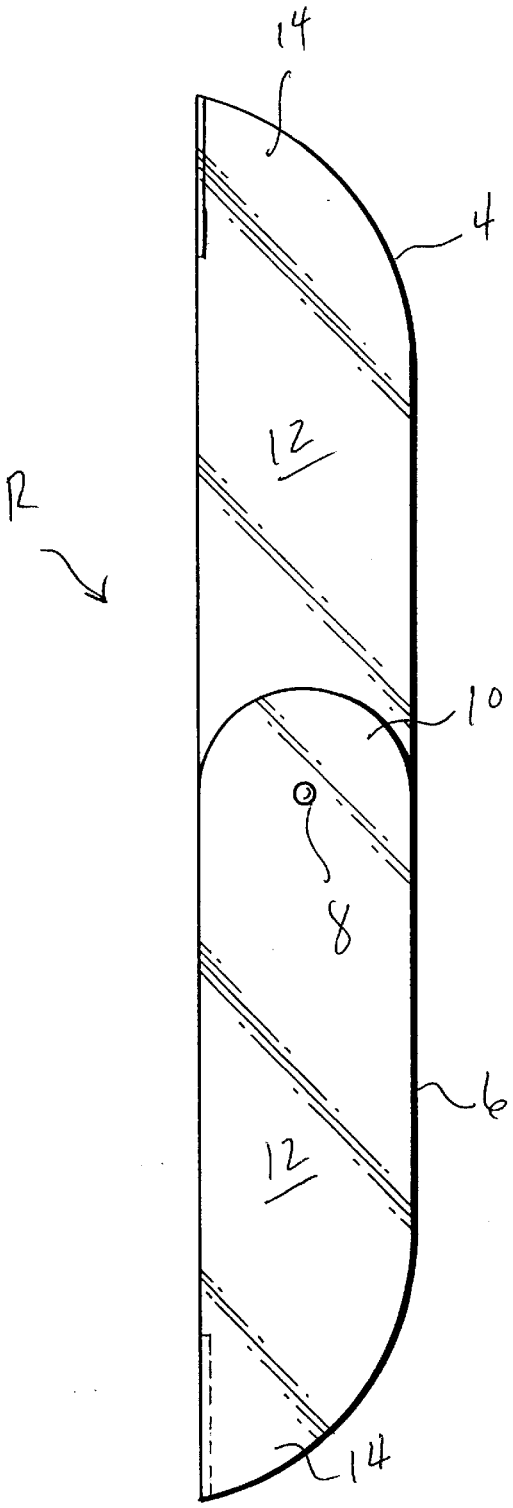
FIG. 2 is a front elevational view of the delineator of FIG. 1, showing the upper and lower reflectors in alignment.
Figure 3:
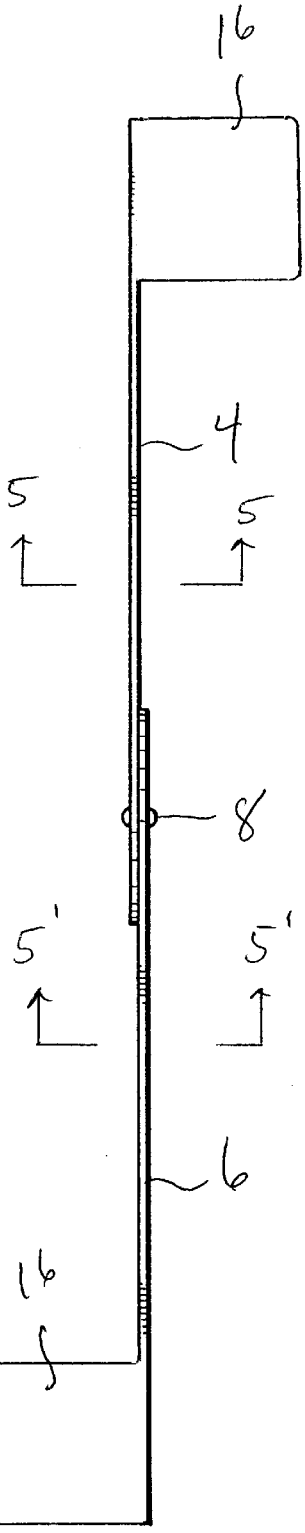
FIG. 3 is a right edge view of FIG. 2.

A roadway delineator R made in accordance with the present invention is disclosed in FIG. 1. The delineator R is shown attached to the side wall 2 of New Jersey-type barrier 3. The barrier 3 includes a wide base 5 from which the side wall 2 extends upwardly in a tapered manner. The cross-sectional shape or profile of the side wall 2 may vary in various areas of the country, although the general shape of a wide base and a narrow wall remains the same.

The delineator R has an upper reflector 4 and a lower reflector 6 joined in a pivoting manner with pivot 8 at their respective ends 10. The surface of the reflectors 4 and 6 that face the traffic are covered with standard retro-reflective sheeting 12 (see FIG. 5). The pivot 8 allows the reflectors 4 and 6 to rotate relative to each other from 0° to 360° to allow the delineator to be fitted to differently angled side walls. The ends 10 are preferably semi-circular and the pivot 8 disposed on the center of the semi-circle so that no edges protrude from the ends 10 when the reflectors 4 and 6 are rotated. The opposite ends 14 of the reflectors 4 and 6 are pointed to direct the driver to where the road ends and the barrier begins with respect to the end 14 of the lower reflector 6. Both the reflectors 4 and 6 are longitudinally shaped to advantageously help the driver visualize the contour of the side wall of the barrier.

Tabs 16 are each located at the respective ends 14. The tabs 16 are used for affixing the delineator to the barrier side wall by standard means, such as with nails, screws, bolts, epoxies, etc. The tabs 16 are preferably integral with the respective reflectors 4 and 6 and are cut from the same sheet material. The tabs are shown rectangular; however, they may be of any shape. Although the tabs 16 are shown disposed perpendicular to the plane of the reflectors 4 and 6, their orientation may be changed to suit the needs of the particular situation.

The reflectors 4 and 6 are preferably identical in shape for ease of manufacture.

The delineator R is useful in defining the side walls of the barrier where it is used in primary and secondary roads. By affixing the delineator R to the side walls of the barrier, with the reflective surfaces 12 facing the traffic, the lower and upper portions of the barrier are defined, providing a higher state of road definition. In bad weather situations when road markings may not be visible, such when it is night and raining when headlight glare on wet roads can sometimes obliterate the road markings or when snow covers the road markings, the delineator R provides greater visibility by highlighting the general shape of the barrier side walls and pointing to the edge of the base, thereby providing safer driving conditions. The driver is then better able to gauge his distance from the barrier. The pivot 8 allows the reflectors 4 and 6 to hinge or rotate relative to each other so that it may be fitted properly to the side walls of the barrier, regardless of its specific profile. Thus, the delineator R is not limited to a specific shape of the barrier.

The reflectors 4 and 6 are preferably fabricated from aluminum sheet which is cut to shape, including the tabs 16. After the reflectors 4 and 6 are cut to shape, the tabs 16 are bent so that they are perpendicular to the face of the reflectors. Other materials, such as plastic, may also be used.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A roadway delineator, comprising:

a) first and second reflectors;

b) a pivot joining respective one ends of said first and second reflectors to allow said first and second reflectors to rotate relative to each other about said pivot to facilitate fitting said reflectors to a side wall of a barrier;

c) said first and second reflectors having first and second tabs, respectively, for attachment to the side wall of the barrier;

d) said tabs are transverse to said first and second reflectors.

2. A roadway delineator as in claim 1, wherein:

a) said first and second reflectors are longitudinal.

3. A roadway delineator as in claim 1, wherein:

a) said first and second reflectors include retro-reflective sheeting.

4. A roadway delineator as in claim 1, wherein:

a) said first and second reflectors are identical in shape.

5. A roadway delineator as in claim 1, wherein:

a) said one ends are half-circular in shape.

6. A roadway delineator as in claim 1, wherein:

a) said first and second reflectors include other ends opposite said one ends; and b) said other ends are pointed in shape.

7. A roadway delineator as in claim 1, wherein:

a) said first and second reflectors include other ends opposite said one ends; and b) said tabs are disposed at said other ends.

8. A roadway delineator as in claim 1, wherein:

a) said tabs are rectangular in shape.

9. A roadway delineator as in claim 1, wherein:

a) said tabs are integral with said first and second reflectors.

10. A roadway delineator as in claim 1, wherein:

a) said tabs extend in opposite directions away from respective said first and second reflectors.

11. A roadway delineator, comprising:

a) first and second longitudinal reflectors joined together at respective one ends;

b) tab secured to at least one of said first and second longitudinal reflectors for attachment to a side wall of a roadway barrier;

c) said first and second longitudinal reflectors are disposed relative to each other at an angle greater than zero when installed to the side wall;

d) said tabs are transverse to said first and second reflectors.

12. A roadway delineator as in claim 11, wherein:

a) said first and second longitudinal reflectors are joined together by a pivot.

13. A roadway delineator as in claim 11, wherein:

a) said first and second longitudinal reflectors include respective tabs.

14. A roadway delineator as in claim 11, wherein:

a) said first and second reflectors are identical in shape.

15. A roadway delineator as in claim 11, wherein:

a) said one ends are half-circular in shape.

16. A roadway delineator as in claim 11, wherein:

a) said first and second reflectors include other ends opposite said one ends; and b) said other ends are pointed in shape.

17. A roadway delineator as in claim 11, wherein:

a) said first and second reflectors include other ends opposite said one ends; and b) said tabs are disposed at said other ends.

18. A roadway delineator as in claim 11, wherein:

a) said tabs are rectangular in shape.

19. A roadway delineator as in claim 11, wherein:

a) said tabs are integral with said first and second reflectors.

20. A roadway delineator, comprising:

a) first and second reflectors;

b) a pivot joining respective one ends of said first and second reflectors to allow said first and second reflectors to rotate relative to each other about said pivot to facilitate fitting said reflectors to a side wall of a barrier;

c) said first and second reflectors having first and second tabs, respectively, for attachment to the side wall of the barrier; and d) said tabs are rectangular in shape.

* * * * *